US008435398B2

(12) United States Patent
Gollan et al.

(10) Patent No.: US 8,435,398 B2
(45) Date of Patent: May 7, 2013

(54) ELECTROLYTE COMPOSITION AND METHOD FOR THE DEPOSITION OF A ZINC-NICKEL ALLOY LAYER ON A CAST IRON OR STEEL SUBSTRATE

(75) Inventors: Dieter Gollan, Markkleeberg (DE); Gerard Patron, Faremoutiers (FR); Thomas Helden, Solingen (DE); Andreas Heinz Kirchhof, Leipzig (DE)

(73) Assignee: Enthone Inc., West Haven, CT (US)

( * ) Notice: Subject to any disclaimer, the term of this patent is extended or adjusted under 35 U.S.C. 154(b) by 629 days.

(21) Appl. No.: 11/778,011

(22) Filed: Jul. 13, 2007

(65) Prior Publication Data

US 2008/0110762 A1 May 15, 2008

(30) Foreign Application Priority Data

Jul. 13, 2006 (EP) ..... 06014519

(51) Int. Cl.
*C25D 3/56* (2006.01)

(52) U.S. Cl.
USPC ..... 205/246

(58) Field of Classification Search ..... 205/246
See application file for complete search history.

(56) References Cited

U.S. PATENT DOCUMENTS

| | | | | |
|---|---|---|---|---|
| 4,146,441 | A * | 3/1979 | Willis | 205/314 |
| 4,388,160 | A | 6/1983 | Rynne | |
| 4,543,166 | A | 9/1985 | Lash | |
| 4,765,871 | A | 8/1988 | Hsu et al. | |
| 4,825,009 | A * | 4/1989 | Edwards | 568/618 |
| 4,832,802 | A | 5/1989 | Canaris | |
| 4,861,442 | A | 8/1989 | Nishihama et al. | |
| 5,718,745 | A * | 2/1998 | Itoh et al. | 106/1.22 |
| 6,238,542 | B1 | 5/2001 | Helden | |
| 2003/0085130 | A1 * | 5/2003 | Verberne et al. | 205/246 |
| 2006/0283715 | A1 * | 12/2006 | Diaddario et al. | 205/245 |

FOREIGN PATENT DOCUMENTS

| | | |
|---|---|---|
| GB | 1498212 | 1/1978 |
| SU | 524866 | 8/1976 |
| SU | 524866 A * | 8/1976 |

OTHER PUBLICATIONS

Pushpavanam, K. et al., "Zinc-Nickel Alloy Deposition in the Presence of Citrate Ions", Journal of Applied Electrochemistry, Oct. 1996, pp. 1065-1069, vol. 26, No. 10.

Office Action dated Sep. 26, 2007, U.S. Appl. No. 10/252,495, 18 pages.

Severin, K. et al, Angew. Chem. Int. Ed., 1998, 37: 1634-1654 "Bioorganometallic Chemistry-Transition Metal Complexes with alpha-Amino Acids".

Micskei et al., Progress in Biological Chirality, 2004, Chapter 18, "Transfer of the Chiral Information of Natural Amino Acids in Biomimetic Organic Synthesis," p. 221-236.

Ghasemi, S. et al. J. Plant Growth Regul., published online Oct. 5, 2012.

* cited by examiner

*Primary Examiner* — Edna Wong
(74) *Attorney, Agent, or Firm* — Senniger Powers LLP

(57) ABSTRACT

The present invention relates to an electrolyte composition as well as a method for the deposition of zinc-nickel alloy layers on substrates, in particular cast iron or steel substrates. The electrolyte compositions according to the invention comprise aminoacetic acid. The alloy layers deposited from the electrolyte compositions according to the invention are corrosion resistant and bright and nearly have no internal tension.

18 Claims, No Drawings

ELECTROLYTE COMPOSITION AND METHOD FOR THE DEPOSITION OF A ZINC-NICKEL ALLOY LAYER ON A CAST IRON OR STEEL SUBSTRATE

The present invention relates to an electrolyte composition for the deposition of a zinc-nickel alloy layer on a substrate, in particular a cast iron or steel substrate.

For improving the surface properties of substrates, in particular with respect to their corrosion resistance, these ones are coated with galvanic coatings. A plurality of different coating methods for the deposition of very different metal layers on substrate surfaces is known from the state of the art. Due to the fact that zinc-nickel alloys present a better corrosion resistance in comparison to pure zinc layers there is a high interest in the deposition of zinc-nickel alloys on substrate surfaces for improving the corrosion resistance.

In particular for meeting the higher requirements of corrosion resistance on cast iron and steel surfaces and in order to fulfil the wish of the automobile and airplane industry to abandon the use of cadmium, different methods for the deposition of zinc-nickel alloy layers on such substrate surfaces were developed in the last few years. It was the common aim of these developments to deposit zinc-nickel alloys with a defined nickel portion. Usually nickel portions comprised between 10 and 15% are deposited by means of the methods known from the state of the art, which offers an as high corrosion resistance as possible.

In order to deposit such zinc-nickel alloys, two different electrolytes are essentially used according to the state of the art. These ones are alkaline zinc-nickel alloying baths on the one hand and weak acid ammonium chloride bearing baths on the other hand. However, both bath types have considerable drawbacks.

If alkaline baths are used, only low deposition speeds can be achieved and difficulties arise in particular for the deposition on cast iron or steel substrates. Another drawback is that these baths contain high concentrations of strong complexing agents, which leads to loads of these often organic complexing agents in the waste waters and thus requires additional waste water purification steps. Ammonium chloride bearing weak acid baths for the deposition of zinc-nickel alloy layers permit to deposit corrosion resistant layers comprising nickel contents in the range comprised between 10 and 15% by mass, but they present the typical drawback of acid electrolytes to often generate non-uniform metal distributions in the layers. Furthermore, the ammonium ions contained in the electrolytes are harmful to the environment and highly contaminate the waste waters. The ammonium concentrations of waste waters from electroplating shops are strictly regulated and are subject to continuous controls. In order to meet the official requirements, extensive and costly waste water purifications have therefore to be carried out. Ammonium chloride bearing zinc-nickel electrolytes for the deposition of corresponding alloy layers are for example known from the U.S. Pat. No. 4,388,160 and U.S. Pat. No. 4,765,871. Furthermore, an ammonium chloride bearing electrolyte on the base of nickel chloride or nickel sulphate as nickel salt carrier is known from U.S. Pat. No. 4,832,802. The above mentioned electrolytes typically comprise ammonium chloride in a concentration of up to 300 g/l, which makes extensive waste water purification necessary.

Due to the generally bad layer thickness and alloying element distributions which are achieved while using such ammonium chloride bearing electrolytes and the waste water problems related to the use of ammonium chloride, zinc-nickel electrolytes that work in the alkaline range have been developed.

The zinc-nickel alloy layers that have been deposited from such alkaline zinc-nickel electrolytes typically present integration rates of 10 to 15% by mass nickel.

A typical electrolyte of this type, as it is also disclosed in U.S. Pat. No. 4,765,871, comprises 6 to 17 g/l zinc, 0.8 to 2.3 g/l nickel and 112 to 186 g/l sodium or potassium hydroxide.

But such electrolytes prove to be not very suitable for the coating of iron cast or high-tensile steels as they are for example used as construction materials for calipers in the automobile industry. Only after expensive surface activation measures and/or previous zinc depositions, such materials can be coated with a zinc-nickel alloy layer that presents a sufficient quality and that has been deposited from an alkaline electrolyte. Besides these problems, also the slow deposition speed reduces the economic result of such coating methods.

From the German Patent Specification DE 101 46 559 an electrolyte on the base of potassium chloride and sodium acetate is known which further comprises salicylic acid and nicotinic acid. As brightener system the herein described electrolyte comprises a system composed of saccharine, a potassium salt of a sulfopropylated polyalkoxylated naphthol and octanolethoxylate. The zinc-nickel alloy layers deposited therefrom are corrosion resistant and mirror-bright polished, but they present a high internal tension.

In view of the above remarks, it is therefore the object of the present invention to provide an electrolyte composition as well as a method for the deposition of a zinc-nickel alloy layer on a substrate, in particular a cast iron or steel substrate that is able to overcome the problems known from the state of the art.

With respect to the electrolyte composition this aim is achieved by an electrolyte composition for the deposition of a zinc-nickel alloy layer on a substrate that is characterized in that the electrolyte composition comprises aminoacetic acid.

The addition of aminoacetic acid to an electrolyte comprising zinc and nickel surprisingly leads to the deposition of zinc-nickel alloy layers that have a nickel portion of 10 to 18% by mass and nearly present no internal tension.

The electrolyte compositions according to the invention are based upon an alkali halide, preferably a potassium halide, most preferably potassium chloride as conducting salt and furthermore comprise an acetate from the group consisting of sodium acetate, potassium acetate or ammonium acetate or mixtures of the same ones.

The electrolyte composition according to the invention has a molar acetate/aminoacetic acid ratio comprised between about 0.35 and about 0.91.

Furthermore, the electrolyte composition according to the invention comprises boric acid and a brightener system consisting of saccharine, benzal acetone, orthochlorobenzaldehyde, octanolethoxylate as well as a potassium salt of a sulfopropylated polyalkoxylated naphthol.

Herein, the concentration of the boric acid can be comprised in a range between about 10 and 30, preferably between 15 and 20 g/l.

The preferably used brightener system comprises 2 to 4 g/l sodium saccharine, 0.025 to 0.2 g/l benzal acetone, 0.006 to 0.01 g/l orthochlorobenzaldehyde, 0.8 to 1.2 g/l octanolethoxylate as well as 2.5 to 3.2 g/l potassium salt of the sulfopropylated polyalkoxylated naphthol. Furthermore, the brightener system can comprise 0.5 to 1.0 g/l pyridine sulphonic acid.

The potassium chloride that is preferably used as conducting salt in the electrolyte composition can be contained in a concentration comprised between about 190 and 220 g/l in the composition.

The aminoacetic acid added according to the invention can be contained in a concentration comprised between 10 and 50 g/l, preferably about 30 g/l in the electrolyte composition depending on the electrolyte system.

With respect to the method, the aim is achieved by a method for the deposition of a zinc-nickel alloy layer on a substrate, in particular a cast iron or steel substrate, in which the substrate to be coated, in particular a cast iron or iron substrate, is brought into contact with the electrolyte composition according to the invention while applying a current.

Herein, the temperature of the electrolyte composition can be comprised between about 20° C. and about 60° C., preferably between 30° C. and 40° C.

The current density that has to be set for the deposition of the layer can be set between about 0.5 and about 5 A/dm$^2$, preferably between 1.0 and 3.5 A/dm$^2$.

The invention shall be exemplarily described by means of the following exemplary embodiments, but the invention cannot be limited to these ones.

EXEMPLARY EMBODIMENT 1

At a temperature comprised between 33 and 36° C. and in a set current density comprised between 1.0 and 3.5 A/dm$^2$, a cast iron substrate is brought into contact with an electrolyte composition of the following type:

| | |
|---|---|
| zinc chloride: | 60-70 g/l |
| nickel chloride × 6H20: | 100-130 g/l |
| potassium chloride: | 190-220 g/l |
| boric acid: | 15-20 g/l |
| sodium acetate * 3$H_2O$: | 25 g/l |
| aminoacetic acid: | 30 g/l |
| sodium saccharine: | 2-4 g/l |
| benzal acetone: | 0.025-0.20 g/l |
| orthochlorobenzaldehyde: | 0.006-0.01 g/l |
| octanolethoxylate: | 0.8-1.2 g/l |
| potassium salt of the sulfopropylated polyalkoxylated naphthol: | 2.5-3.2 g/l. |

The pH value of the here described electrolyte composition is comprised between 5 and 6.

EXEMPLARY EMBODIMENT 2

At a temperature comprised between 33 and 36° C. and in a set current density comprised between 1.0 and 3.5 A/dm$^2$, a cast iron substrate is brought into contact with an electrolyte composition of the following type:

| | |
|---|---|
| zinc chloride: | 60-70 g/l |
| nickel chloride × 6H20: | 100-130 g/l |
| potassium chloride: | 190-220 g/l |
| boric acid: | 15-20 g/l |
| sodium acetate * 3$H_2O$: | 25 g/l |
| aminoacetic acid: | 30 g/l |
| sodium saccharine: | 2-4 g/l |
| benzal acetone: | 0.025-0.050 g/l |
| pyridine sulphonic acid: | 0.5-1.0 g/l |
| octanolethoxylate: | 0.8-1.2 g/l |
| potassium salt of the sulfopropylated polyalkoxylated naphthol: | 2.5-3.2 g/l |

The pH value of the here described electrolyte composition is comprised between 5 and 6.

EXEMPLARY EMBODIMENT 3

At a temperature comprised between 33 and 35° C. steel substrates and steel substrates for barrel plating were brought into contact with an electrolyte composition of the following type:

| | |
|---|---|
| zinc chloride: | 60-76 g/l |
| nickel chloride × 6H20: | 100-130 g/l |
| potassium chloride: | 190-220 g/l |
| boric acid: | 15-20 g/l |
| potassium acetate: | 25 g/l |
| aminoacetic acid: | 30 g/l |
| sodium saccharine: | 2-4 g/l |
| benzal acetone: | 0.025-0.050 g/l |
| orthochlorobenzaldehyde: | 0.008-0.012 g/l |
| octanolethoxylate: | 0.8-1.2 g/l |
| potassium salt of the sulfopropylated polyalkoxylated naphthol: | 2.5-3.2 g/l. |

Herein, a current density comprised between 0.5 and 1.0 A/dm$^2$ was set. The pH value of the electrolyte composition was comprised between 5 and 6.

The invention claimed is:

1. A method for the deposition of a zinc-nickel alloy layer on a substrate comprising:

contacting a substrate of cast iron or steel with an electrolytic composition comprising a source of zinc ions, a source of nickel ions, aminoacetic acid, and an acetate selected from the group consisting of sodium acetate, potassium acetate, ammonium acetate, and mixtures thereof, wherein the acetate and aminoacetic acid are present in a molar ratio of acetate:aminoacetic acid between about 0.35:1 and about 0.91:1; and applying a current to form the zinc-nickel alloy layer having a nickel content of between 10 and 18 wt % on the substrate and substantially no internal tension.

2. The method of claim 1 wherein the electrolytic composition further comprises a potassium halide.

3. The method of claim 1 wherein the electrolytic further comprises potassium chloride.

4. The method of claim 1 wherein the electrolytic composition comprises 10 to 50 g/L of the aminoacetic acid.

5. The method of claim 1 wherein the electrolytic composition further comprises boric acid.

6. The method of claim 1 wherein the electrolytic composition further comprises potassium chloride and boric acid.

7. The method of claim 1 wherein the electrolytic composition further comprises from 190 to 220 g/L potassium chloride.

8. The method of claim 1 wherein the electrolytic composition further comprises 10 to 30 g/L boric acid.

9. The method of claim 1 wherein the electrolytic composition further comprises from 190 to 220 g/L potassium chloride and from 10 to 30 g/L boric acid.

10. The method of claim 1 wherein the contacting is at a temperature between 30° C. and 40° C.

11. The method of claim 1 wherein the current has a current density between about 0.5 and about 5 A/dm$^2$.

12. The method of claim 1 wherein the current has a current density between 1.0 and 3.5 A/dm$^2$.

13. The method of claim 1 wherein the current has a density between 1.0 and 3.5 A/dm$^2$, and the electrolytic composition has a pH between 5 and 6 and comprises:

| | | |
|---|---|---|
| zinc chloride: | 60-70 | g/L |
| nickel chloride × $6H_2O$: | 100-130 | g/L |
| potassium chloride: | 190-220 | g/L |
| boric acid: | 15-20 | g/L |
| sodium acetate × $3H_2O$: | 25 | g/L |
| aminoacetic acid: | 30 | g/L |
| sodium saccharine: | 2-4 | g/L |
| benzal acetone: | 0.025-0.2 | g/L |
| orthochlorobenzaldehyde: | 0.006-0.01 | g/L |
| octanolethoxylate: | 0.8 to 1.2 | g/L |
| potassium salt of sulfopropylated polyalkoxylated naphthol: | 2.5 to 3.2 | g/L. |

14. The method of claim 1 wherein the current has a density between 1.0 and 3.5 A/dm$^2$, and the electrolytic composition has a pH between 5 and 6 and comprises:

| | | |
|---|---|---|
| zinc chloride: | 60-70 | g/L |
| nickel chloride × $6H_2O$: | 100-130 | g/L |
| potassium chloride: | 190-220 | g/L |
| boric acid: | 15-20 | g/L |
| sodium acetate × $3H_2O$: | 25 | g/L |
| aminoacetic acid: | 30 | g/L |
| sodium saccharine: | 2-4 | g/L |
| benzal acetone: | 0.025-0.05 | g/L |
| pyridine sulphonic acid: | 0.5-1.0 | g/L |
| octanolethoxylate: | 0.8 to 1.2 | g/L |
| potassium salt of sulfopropylated polyalkoxylated naphthol: | 2.5 to 3.2 | g/L. |

15. The method of claim 1 wherein the current has a density between 0.5 and 1.0 A/dm$^2$, and the electrolytic composition has a pH between 5 and 6 and comprises:

| | | |
|---|---|---|
| zinc chloride: | 60-76 | g/L |
| nickel chloride × $6H_2O$: | 100-130 | g/L |
| potassium chloride: | 190-220 | g/L |
| boric acid: | 15-20 | g/L |
| potassium acetate: | 25 | g/L |
| aminoacetic acid: | 30 | g/L |
| sodium saccharine: | 2-4 | g/L |
| benzal acetone: | 0.025-0.05 | g/L |
| orthochlorobenzaldehyde: | 0.008-0.12 | g/L |
| octanolethoxylate: | 0.8 to 1.2 | g/L |
| potassium salt of sulfopropylated polyalkoxylated naphthol: | 2.5 to 3.2 | g/L. |

16. The method of claim 1 wherein the current has a density between 1.0 and 3.5 A/dm$^2$, and the electrolytic composition has a pH between 5 and 6 and comprises:

| | | |
|---|---|---|
| zinc chloride: | 60-70 | g/L |
| nickel chloride × $6H_2O$: | 100-130 | g/L |
| potassium chloride: | 190-220 | g/L |
| boric acid: | 15-20 | g/L |
| sodium acetate × $3H_2O$: | 25 | g/L |
| aminoacetic acid: | 30 | g/L |
| sodium saccharine: | 2-4 | g/L |
| octanolethoxylate: | 0.8 to 1.2 | g/L |

a brightener system comprising a brightener selected from the group consisting of benzal acetone, orthochlorobenzaldehyde, potassium salt of sulfopropylated polyalkoxylated naphthol, pyridine sulfonic acid, and combinations thereof.

17. The method of claim 1 wherein the current has a density between 1.0 and 3.5 A/dm$^2$, and the electrolytic composition has a pH between 5 and 6 and consists essentially of:

| | | |
|---|---|---|
| zinc chloride: | 60-70 | g/L |
| nickel chloride × $6H_2O$: | 100-130 | g/L |
| potassium chloride: | 190-220 | g/L |
| boric acid: | 15-20 | g/L |
| sodium acetate × $3H_2O$: | 25 | g/L |
| aminoacetic acid: | 30 | g/L |
| sodium saccharine: | 2-4 | g/L |
| benzal acetone: | 0.025-0.2 | g/L |
| orthochlorobenzaldehyde: | 0.006-0.01 | g/L |
| octanolethoxylate: | 0.8 to 1.2 | g/L |
| potassium salt of sulfopropylated polyalkoxylated naphthol: | 2.5 to 3.2 | g/L. |

18. The method of claim 1 wherein the current has a density between 1.0 and 3.5 A/dm$^2$, and the electrolytic composition has a pH between 5 and 6 and consists essentially of:

| | | |
|---|---|---|
| zinc chloride: | 60-70 | g/L |
| nickel chloride × $6H_2O$: | 100-130 | g/L |
| potassium chloride: | 190-220 | g/L |
| boric acid: | 15-20 | g/L |
| sodium acetate × $3H_2O$: | 25 | g/L |
| aminoacetic acid: | 30 | g/L |
| sodium saccharine: | 2-4 | g/L |
| octanolethoxylate: | 0.8 to 1.2 | g/L |

a brightener system comprising a brightener selected from the group consisting of benzal acetone, orthochlorobenzaldehyde, potassium salt of sulfopropylated polyalkoxylated naphthol, pyridine sulfonic acid, and combinations thereof.

* * * * *